US012644625B2

(12) United States Patent
Moerings

(10) Patent No.: US 12,644,625 B2
(45) Date of Patent: Jun. 2, 2026

(54) HEATING DEVICE FOR LIQUIDS

(71) Applicant: Reflexy Nederland B.V., Winkel (NL)

(72) Inventor: Leonardus Gijsbertus Theodorus Moerings, Winkel (NL)

(73) Assignee: Reflexy Nederland B.V., Winkel (NL)

( * ) Notice: Subject to any disclaimer, the term of this patent is extended or adjusted under 35 U.S.C. 154(b) by 1082 days.

(21) Appl. No.: 17/626,929

(22) PCT Filed: Jul. 15, 2020

(86) PCT No.: PCT/EP2020/070034
§ 371 (c)(1),
(2) Date: Jan. 13, 2022

(87) PCT Pub. No.: WO2021/009249
PCT Pub. Date: Jan. 21, 2021

(65) Prior Publication Data

US 2022/0260279 A1 Aug. 18, 2022

(30) Foreign Application Priority Data

Jul. 16, 2019 (NL) ..... 2023510

(51) Int. Cl.
*F24H 1/16* (2022.01)

(52) U.S. Cl.
CPC ..... *F24H 1/162* (2013.01); *F24H 2250/14* (2013.01)

(58) Field of Classification Search
CPC ..... A47J 37/1233; F24D 7/00; F24H 1/162; F24H 2250/14
USPC ..... 392/481
See application file for complete search history.

(56) References Cited

U.S. PATENT DOCUMENTS 5,590,240 A * 12/1996 Rezabek ..... F24H 1/162 165/184
7,673,814 B2 * 3/2010 Shank ..... F24H 1/188 219/202
8,670,656 B2 3/2014 Nishida et al.
2003/0180034 A1 * 9/2003 Saito ..... H05B 3/145 392/407
2012/0063754 A1 * 3/2012 Nishida ..... H05B 1/0247 392/416
2016/0113431 A1 * 4/2016 Sotome ..... H05B 3/44 392/416

FOREIGN PATENT DOCUMENTS

CN 107238193 A * 10/2017
CN 109297182 A 1/2019
(Continued)

*Primary Examiner* — Steven W Crabb
*Assistant Examiner* — Ket D Dang
(74) *Attorney, Agent, or Firm* — Hoffmann & Baron, LLP

(57) ABSTRACT

A heating device for heating a liquid includes at least one infrared heat source, such as an infrared lamp, accommodated in a corresponding casing of a heat conducting material. The heating device furthermore includes a conduit of a heat conducting material, where the conduit has an inlet and an outlet and where liquid to be heated in use flows through the conduit from the inlet towards the outlet. The conduit is wound spirally around the casing of the infrared heat source to facilitate, in use, the emission of infrared radiation by the heat source through the casing and the conduit into the liquid flowing through the conduit so as to heat the liquid.

22 Claims, 7 Drawing Sheets

(56) References Cited

FOREIGN PATENT DOCUMENTS

| | | | | |
|---|---|---|---|---|
| DE | 7732126 | U1 | | 9/1978 |
| KR | 2006-0119089 | A | | 11/2006 |
| KR | 20090000755 | U | * | 1/2009 |
| KR | 2010-0062318 | A | | 6/2010 |
| KR | 2012-0031833 | A | | 4/2012 |
| WO | 2008/010631 | A1 | | 1/2008 |
| WO | 2018/080885 | A1 | | 5/2018 |

* cited by examiner

HEATING DEVICE FOR LIQUIDS

CROSS-REFERENCE TO RELATED APPLICATIONS

This application is the National Stage of International Application No. PCT/EP2020/070034, filed Jul. 15, 2020, which claims the benefit of Netherlands Application No. 2023510, filed Jul. 16, 2019, the contents of which is incorporated by reference herein.

FIELD OF THE INVENTION

The present invention relates to a heating device for heating a liquid, comprising at least one infrared heat source, such as an infrared lamp, accommodated in a corresponding casing of a heat conducting material, and a conduit of a heat conducting material, wherein the conduit has an inlet and an outlet and wherein liquid to be heated in use flows through the conduit from the inlet towards the outlet.

BACKGROUND OF THE INVENTION

Heating devices for heating a liquid using infrared heat sources are known. They generally comprise one or more infrared heat sources placed in the proximity of a conduit through which the liquid to be heated flows. Generally, the conduit is made of a heat conducting material, whereby both the conduit and the liquid are heated by the infrared source.

Most of such heating devices do not place the infrared heat source directly into the liquid, since the heating source does not function optimally in such conditions and because this results in sediments sticking to the heat source, which means the heat reaches the liquid less efficiently. Instead, a casing is placed around the infrared heat source, and the liquid flows around the casing. For example, KR 2012 0031833 describes an electrical boiler for heating a liquid using infrared heat sources. The heat sources are placed in a casing, and around the casing two cylinders are placed, where the inner cylinder is a screw cylinder. The liquid flows between the two cylinders, and the screw cylinder causes the liquid to flow in a spiral around the heat source. This cylindrical flow lengthens the path of the liquid in the proximity of the heat source, and therefore allows for heating to a higher temperature. When multiple heat sources are used, the outer cylinders are coupled together at the ends.

Heating devices with one or more cylinders around the casings, in between which the liquid flows, require liquid sealed couplings for each heat source that is used. The liquid inlet and outlet require a coupling, and any two cylinders require a coupling to interconnect them. A problem with such heating devices is that every coupling increases the risk of leakage in the system. As the number of heat sources increases, the risk of leakage also increases.

SUMMARY OF THE INVENTION

An object of the invention is to solve this problem.

For this purpose, a heating device according to the present invention is proposed, wherein the conduit is wound spirally around the casing of the infrared heat source to facilitate, in use, the emission of infrared radiation by the heat source through the casing and the conduit into the liquid flowing through the conduit so as to heat the liquid.

In a preferred embodiment the heating device comprises a plurality of said infrared heat sources, each accommodated in a respective casing, wherein the conduit is wound around each one of the casings.

According to the invention the heating device thus has a single conduit through which liquid to be heated flows. The single conduit is wound spirally around each one of the one or more casings of the infrared heat sources. In use, the liquid which flows through the conduit is heated by infrared radiation emitted by the one or more heat sources. The infrared radiation goes through the casing and the conduit, and into the liquid. Because the single conduit is wound around each of the infrared heat sources, there is no need for extra couplings when there are more infrared heat sources present.

The number of heat sources can be chosen such that they supply sufficient heat to bring the liquid to the desired temperature. This number may be different for different liquids and applications. The heat sources may be infrared lamps, in particular quartz infrared lamps.

The casing according to the invention is made of a heat conducting material, and may be made in such a way, that the infrared heat source can be removed from the casing without changing the position of the casing. For example, the casing may be a cylinder with a lid on one end, through which an infrared heat source can be entered and removed. Such a casing allows for easy replacement of the infrared heat source, when this is necessary.

The conduit according to the invention is also made of a heat conducting material. As it is wound spirally around the casing, which is also heat conducting, the infrared heat source can heat the liquid in the conduit. By placing the conduit spirally around the casing, the path of the liquid in the proximity of the infrared heat source is lengthened compared to a straight conduit. The conduit is preferably a flexible conduit which is wound around the casing, but may also be pre-formed into a spiral which fits around the casing or casings. In the case of the flexible conduit, it may be a corrugated flexible pipe. The conduit is preferably made of metal.

In a preferred embodiment the heating device according to the invention comprising a housing, wherein the conduit and each of the one or more casings of the infrared heat sources, around which the conduit is wound, are arranged in the housing.

Preferably the housing contains a thermal buffering material or medium which surrounds the conduit and the one or more casings. By arranging a thermal buffer around the combination of the conduit and each of the one or more casings, heat is preserved when the infrared heat sources are turned off, thus lowering the thermal load on the infrared heat sources when they are turned on again to heat the liquid.

In a possible embodiment the thermal buffering material is a heat insulating material. This insulation ensures that the heat from the infrared heat source mainly heats the casing, conduit and liquid, and does not spread freely into the surrounding space. This prevents excessive heating of the area around the device, and increases the efficiency of the heating device.

In a possible practical embodiment the thermal buffering material is formed by a layer of heat insulating material which is arranged around the assembly of the conduit and the one or more casings of the infrared heat sources through a process of pouring and hardening. By using such a pouring and hardening process, the initially fluid insulating material can flow around the irregular shapes of the conduit and the casing and when it hardens forms an insulating block around the conduit and the casings. The remaining air within the heating device is minimized. When the insulating material hardens, the conduit and the casings are fixed in place.

In a possible further embodiment, the insulating material is a mix of glass granulate and alumina cement. Also an insulating layer entirely made of glass is conceivable.

It should be noted that it is possible to add more layers of insulating material. For example, a mix of glass granulate and alumina cement may be used, around which one or more layers of aerogel are placed. Other combinations are also envisaged.

In another possible embodiment the thermal buffering medium may be a fluid.

In a possible embodiment of the heating device according to the invention the housing defines a chamber surrounding the conduit and the one or more casings, said chamber being adapted to contain a fluid, and said chamber having a chamber inlet and a chamber outlet for the fluid, wherein, in use, the fluid flows through the chamber from the chamber inlet to the chamber outlet. This embodiment is particularly effective in a liquid heating system in which two liquids have to be heated and circulated each through their own circuit. One of the liquids flows through the heating device via the conduit, the other one of the liquids flows through the heating device via the chamber. The infrared heat sources heat the liquid flowing through the conduit directly and to some extent also the other liquid in the chamber. However, since the liquid in the chamber flows along the outer side of the conduit, heat exchange takes place between the two liquids via the conduit wall. This may result in that for example the heat up time for liquid in the conduit is reduced when the power of the infrared heat sources was reduced and is increased again.

According to a possible embodiment, the inlet and the outlet of the conduit extend from the housing, so as to allow attachment thereof to a source of the liquid and a desired outflow for the liquid. This allows for a simple removal of the entire heating device from a liquid circuit, and for simple attachment to other systems. In the case of a problem with a heating device, a new one can be installed with little effort, shortening the non-functional time and making reparations simpler.

According to a further embodiment, at least one end of the one or more casings extends from the housing, so as to allow insertion or removal of the infrared heat source(s) from the casing(s). Thus, the heating device does not need to be dismantled to replace the infrared sources. Only the end of one of the casings needs to be removed, to replace an infrared heat source.

According to a further embodiment, the casings are placed parallel to each other.

According to a further embodiment, each of the casings has a proximal end and a distal end, wherein the proximal ends of the casings are all located at the same side, and in that the conduit extends around one of the casings from the proximal end to the distal end and extends around a next and/or a previous casing(s) from the distal end to the proximal end, whereby a back-and-forth flow path is created. In this layout, the tension in the materials in the heating device occurring due to the temperature differences decreases, because the water flows back and forth as it is heated, creating a relatively uniform heat distribution in the assembly of casings and conduit wound around the casings.

According to a further embodiment, the conduit forms a spiral around each of the casings wherein the spiral around one of the casings is in thermal contact with the spiral around at least one other of the casings. By placing the casings in close proximity to each other and different sections of the spiralling conduit in contact with each other, the heat of the different infrared heat sources has an effect on both the liquid in the conduit around its own casing, but also on the liquid in nearby casings. Additionally, the heat of the liquid in touching segments of the conduits is shared, whereby the efficiency increases.

According to a further embodiment, the casings and the infrared sources inside the casings are positioned in a round or polygonal configuration, the conduit is wound spirally around each of said casings, and an additional casing with an additional infrared heat source is placed at the centre of the configuration and in thermal contact with the conduit. In this embodiment, more than one infrared heat source is present for each of the spiralling conduits. This increases the available heating power for the amount of liquid present in the heating device.

An example of this embodiment would be a heating device where five infrared heat sources are used, each in its own casing. Four of these are placed as though they are the corners of a rectangle or square, and the conduit is wrapped around these to form a back-and-forth flow path for the liquid. At the centre of the rectangle or square, the fifth infrared heat source is placed in its casing. The other four casings are located in such a way, that the conduit wound around them also touches the casing of the fifth infrared heat source. A similar example may also be conceived with less or more infrared heat sources with conduits wound around them, located around one or more infrared sources without conduits.

According to another embodiment, each one of the infrared heat sources is separately operable. This allows for a heating device which can heat the liquid to a set of temperatures, by turning on different numbers of heat sources. Additionally, it allows for a longer life time of the device, by placing more heat sources than required, and thereby reducing the burning hours per heat source. This is especially beneficial in a situation where regular replacement of the heat sources is undesirable.

According to another embodiment, each one of the one or more infrared heat sources is adapted to be operated at variable wattages. This allows for a heating device which can heat the liquid to a range of different temperatures, by turning up or down the wattages at which the heat sources function.

According to another embodiment, the infrared heat source is an infrared lamp, preferably a quartz infrared lamp. These are readily available, and do not need to be adapted for use in a heating device according to the invention.

Depending on the purpose and application of the heating device according to the invention, the different parts may be made of suitable materials. In general suitable materials may be metal, in particular steel, for central heating purposes or for application in kitchen appliances. Another feasible material may be glass for, for example, heating purposes in a laboratory environment, for example for an evaporator/condenser assembly.

Thus, in a possible embodiment of the heating device the casing may be made of metal, preferably stainless steel. In such an embodiment the conduit may also be made of metal, preferably stainless steel and also the housing may be made of metal, preferably stainless steel.

In another possible embodiment the casing may be made of glass, the conduit may be made of glass and the housing may be made of glass. However also embodiments with a mix of metal and glass parts is conceivable.

The invention also relates to a liquid heating system comprising a heating device as described in any of the above, wherein the heating system furthermore comprises a first liquid circulation circuit including a pump and circulation conduits, wherein the conduit of the heating device is comprised in the first liquid circulating circuit.

The invention also relates to a liquid heating system comprising a heating device for heating a liquid, wherein the heating device comprises:

- at least one infrared heat source, such as an infrared lamp, accommodated in a corresponding casing of a heat conducting material;
- a conduit of a heat conducting material, wherein the conduit has an inlet and an outlet and wherein liquid to be heated in use flows through the conduit from the inlet towards the outlet; and
- a housing, wherein the conduit and each of the one or more casings of the infrared heat sources around which the conduit is wound are arranged in the housing.

The conduit is wound spirally around the casing of the infrared heat source to facilitate, in use, the emission of infrared radiation by the heat source through the casing and the conduit into the liquid flowing through the conduit so as to heat the liquid. The housing defines a chamber surrounding the conduit and the one or more casings, said chamber being adapted to contain a fluid, and said chamber having a chamber inlet and a chamber outlet for the fluid, wherein, in use, the fluid flows through the chamber from the chamber inlet to the chamber outlet. The heating system furthermore comprises a first liquid circulation circuit including a first pump and first circulation conduits, wherein the conduit of the heating device is comprised in the first liquid circulating circuit, and wherein the heating system furthermore comprises a second liquid circulation circuit, wherein the second liquid circulating circuit includes a second pump and second circulation conduits, wherein the chamber of the heating device is comprised in the second liquid circulating circuit.

Another aspect of the invention relates to a liquid heating system comprising:

- a heating device for heating a liquid, said heating device comprising:
  - at least one heat source, preferably an infrared heat source such as an infrared lamp, accommodated in a corresponding casing of a heat conducting material,
  - a closed conduit made of a heat conducting material, wherein the conduit has an inlet and an outlet and wherein liquid to be heated in use flows through the conduit from the inlet towards the outlet,
  - a housing, wherein the conduit and each of the one or more casings of the heat sources are arranged in the housing, wherein the housing defines a chamber surrounding the conduit and the one or more casings, said chamber being adapted to contain a fluid, and said chamber having a chamber inlet and a chamber outlet for the fluid, wherein, in use, the fluid flows through the chamber from the chamber inlet to the chamber outlet,
- a first liquid circulation circuit including a first pump and first circulation conduits, wherein the conduit of the heating device is comprised in the first liquid circulating circuit,
- a second liquid circulation circuit, wherein the second liquid circulating circuit includes a second pump and second circulation conduits, wherein the chamber of the heating device is comprised in the second liquid circulating circuit.

In the heating system according to this aspect the conduit is not necessarily wound spirally around the casing of the heat source, but may also be arranged in other ways in the housing and near the casing of the heat source(s).

The heating device and the liquid heating systems as described can be used in many different applications.

A possible application may be in deep frying system which comprises a liquid heating system as described in the foregoing which furthermore comprises a deep frying pan for containing a frying medium, such as frying oil, wherein the heating device and the deep frying pan are incorporated in the first liquid circulating circuit for circulating frying medium between the heating device and the deep frying pan, said first liquid circulating circuit furthermore comprising a filter for filtering the frying medium, and wherein the deep frying system furthermore comprises a buffer chamber at least partly surrounding the deep frying pan, which buffer chamber is incorporated in the second liquid circulating circuit for circulating a buffer medium between the heating device and the buffer chamber.

In this embodiment there are thus two mediums which are circulated through their own circuit. The first medium is the frying medium, which may be a frying oil, which is circulated from the frying pan to the heating device. The second medium may for example be a thermal oil, which is circulated between the buffer chamber and the heating device. Heat exchange between the first and second liquid circulating circuits takes place in the heating device between the chamber of the heating device and the conduit running through said chamber, and between the frying pan and the surrounding buffer chamber. This particular embodiment of a deep frying system has proven to be surprisingly effective, wherein a short initial heating time to operation temperature is necessary and wherein a temperature drop, when for example frozen good is submerged in the frying oil, is minimized, and may be only about 2° C. This is very good for the quality of the fried goods. Moreover it may lead to an energy use which is about half of the energy use of a conventional energy use of conventional deep frying systems of a similar size using induction to heat the frying pan.

Another possible embodiment of a deep frying system comprises only one liquid circulating circuit for the frying medium. This deep frying system comprises a liquid heating system including a heating device for heating a liquid and a first liquid circulation circuit. The heating device comprises at least one infrared heat source, such as an infrared lamp, accommodated in a corresponding casing of a heat conducting material, and a conduit of a heat conducting material, wherein the conduit has an inlet and an outlet and wherein liquid to be heated in use flows through the conduit from the inlet towards the outlet, wherein the conduit is wound spirally around the casing of the infrared heat source to facilitate, in use, the emission of infrared radiation by the heat source through the casing and the conduit into the liquid flowing through the conduit so as to heat the liquid. The first liquid circulation circuit includes a pump and circulation conduits, wherein the conduit of the heating device is comprised in the first liquid circulating circuit. The deep frying system furthermore comprises a deep frying pan for containing a frying medium, such as frying oil. The heating device and the deep frying pan are incorporated in the first liquid circulating circuit for circulating frying medium between the heating device and the deep frying pan, said first liquid circulating circuit furthermore comprising a filter for filtering the frying medium.

In another practical application of the invention a central heating system comprises a liquid heating system as described in the above.

The central heating system may comprise a closed radiator circuit in which at least one radiator is comprised, wherein the central heating system furthermore comprises a heat exchanging arrangement to exchange heat between the first closed circuit and the closed radiator circuit. The first liquid in the first closed circuit may be a thermal oil. The liquid in the closed radiator circuit may be water or glycol.

The heating device is used to heat water to the desired temperature, which then moves through radiators to warm up an area to a desired temperature. When the desired room temperature is increased, or the actual, measured temperature decreases, the water temperature can be increased, or the flow speed of the water can be increased. A circular flow of water may be used, where the outlet of the heating device is directly connected to the inlet thereof, through the network of radiators.

In a possible further embodiment the central heating system furthermore comprises a warm water reservoir, wherein a further heat exchanging arrangement is present between the first closed circuit and the warm water reservoir, to heat the water in said reservoir.

Also other applications are conceivable for the heating device and heating system according to the invention. For example in kitchen appliances such as dish washers, ovens, warm keeping tables. Or for example in laboratory applications in which a medium has to be heated, for example ton evaporate a liquid. Also for a tropical acquarium the liquid heating system may be used. Another application is floor heating systems.

BRIEF DESCRIPTION OF THE DRAWINGS

The invention will be further elucidated in the following description of possible embodiments with reference to the drawings, wherein.

DETAILED DESCRIPTION OF THE INVENTION

Figure 1:
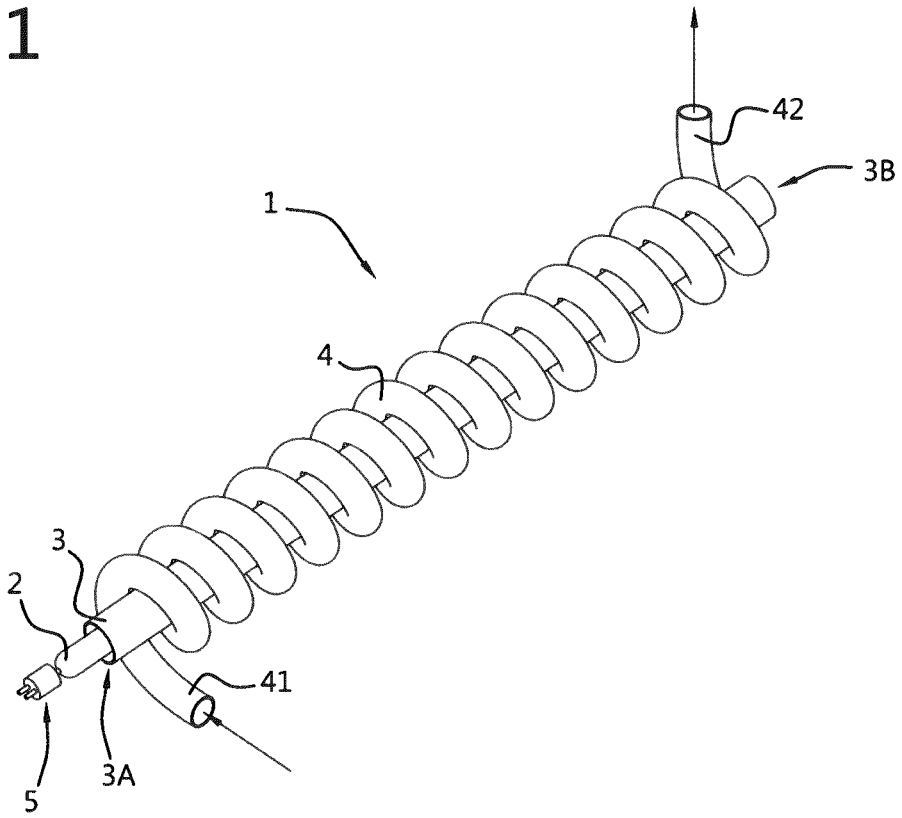
FIG. 1 shows in a view in perspective an embodiment of a heating device according to the invention, with one heat source and one respective casing.

In FIG. 1, a heating device 1 is shown which comprises an infrared heat source 2 with a casing 3. The casing 3 is in the embodiment shown a tubular element having a proximal end 3A and a distal end 3B. The infrared heat source 2 is inserted in the casing from the proximal end 3A of the casing. In a preferred embodiment the infrared heat source is a quartz infrared lamp.

In FIG. 1, the infrared heat source 2 is shown having a connector 5 which in this figure is not connected to a power supply. However, in use, the heat source 2 would be connected to such a power supply by the connector 5. An end cap (not shown) of the casing 3 may be used, through which power can reach the heat source 2.

The heating device 1 further comprises a conduit 4 through which in use a liquid to be heated flows. The flow is illustrated by the arrows at an inlet 41 and an outlet 42 of the conduit 4. The conduit 4 is wound spirally around the casing 3 and the heat source 2 accommodated in the casing 3. The liquid, entering to the conduit inlet 41 and leaving through the conduit outlet 42, therefore flows around the casing 3 and the heat source 2 therein, and is heated by the heat generated by the heat source 2.

The liquid passing through the conduit swirls due to the spiral-shape of the conduit. Although not wishing to be bound by any theory, it is believed that the swirling movement facilitates the heating of the liquid.

The conduit 4 is spirally wound around the casing 3. FIG. 1 shows a loose spiral, in which the different loops are not in contact. A tight spiral, where each loop is in direct contact with the next, is also possible. When a loose spiral is used, it is possible to wind a second conduit 4 spirally around the same casing 3, in the space between the loops of the first spiral. Alternatively, the same conduit 4 may be wound in a loose spiral in the original direction, and then back in a second spiral in opposite direction, around the same casing 3, placing the loops of the second spiral in between the loops of the first spiral. In such a configuration, the heated liquid flowing toward conduit outlet 42 can also impart heat to the unheated liquid flowing from conduit inlet 41.

Figure 2:
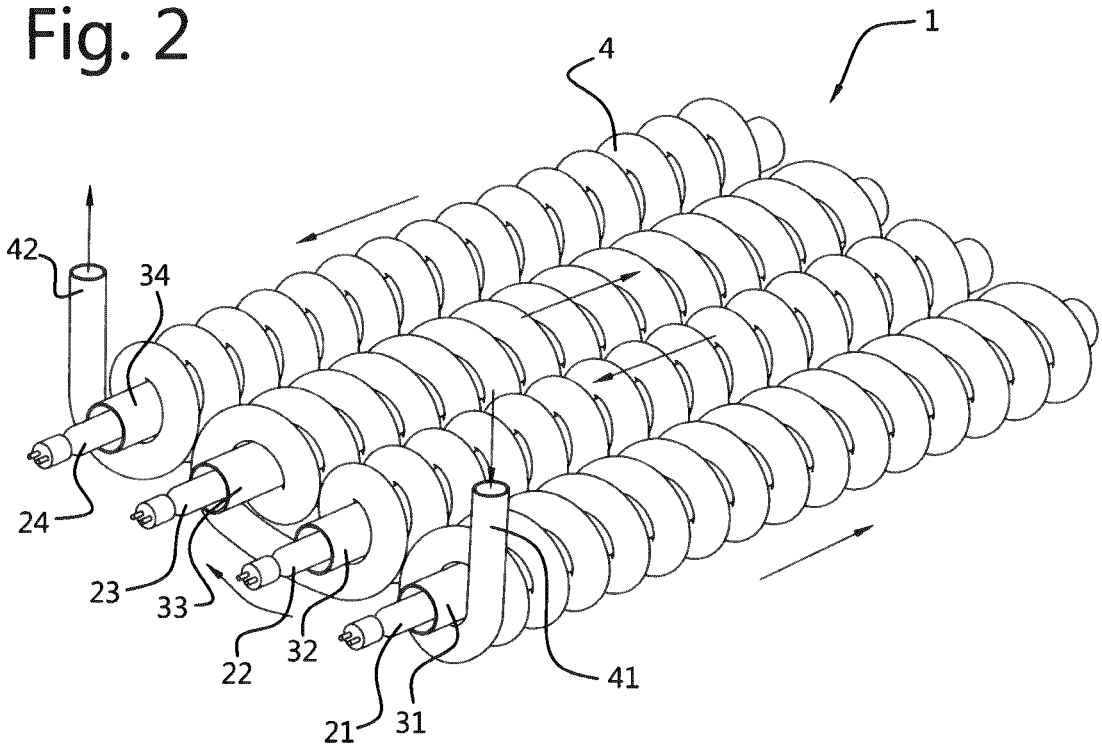
FIG. 2 shows in a view in perspective an embodiment of a heating device according to the invention, with four heat sources and four respective casings.

In FIG. 2, a heating device 1 is shown which comprises four infrared heat sources 21, 22, 23, 24 accommodated in four casings 31, 32, 33, 34, respectively. The infrared heat sources 21, 22, 23, 24 may comprise infrared quartz lamps.

A single conduit 4, through which in use a liquid to be heated flows, is wound spirally around each of the casings 31, 32, 33, 34. The flow of the liquid is illustrated by arrows at the inlet 41 and the outlet 42 of the conduit 4. The four casings 31, 32, 33, 34 are positioned parallel to each other, and the conduit 4 spirals around the first casing 31 and the third casing 33 in one longitudinal direction, and around the second casing 32 and the fourth casing 34 in the opposite longitudinal direction.

The casings 31, 32, 33, 34 are spaced such that the loops of the conduit 4 around any one casing touch the loops around the one or two casings beside it. In this configuration, the liquid in the sections of the conduit 4 around the casings 31, 32, 33, 34 can also impart their heat on the liquid in the section of the conduit 4 around the adjacent casing 31, 32, 33, 34. The spirals around each of the casings 31, 32, 33, 34 may be wound loosely or tightly. FIG. 2 shows a loose winding.

Figure 3:
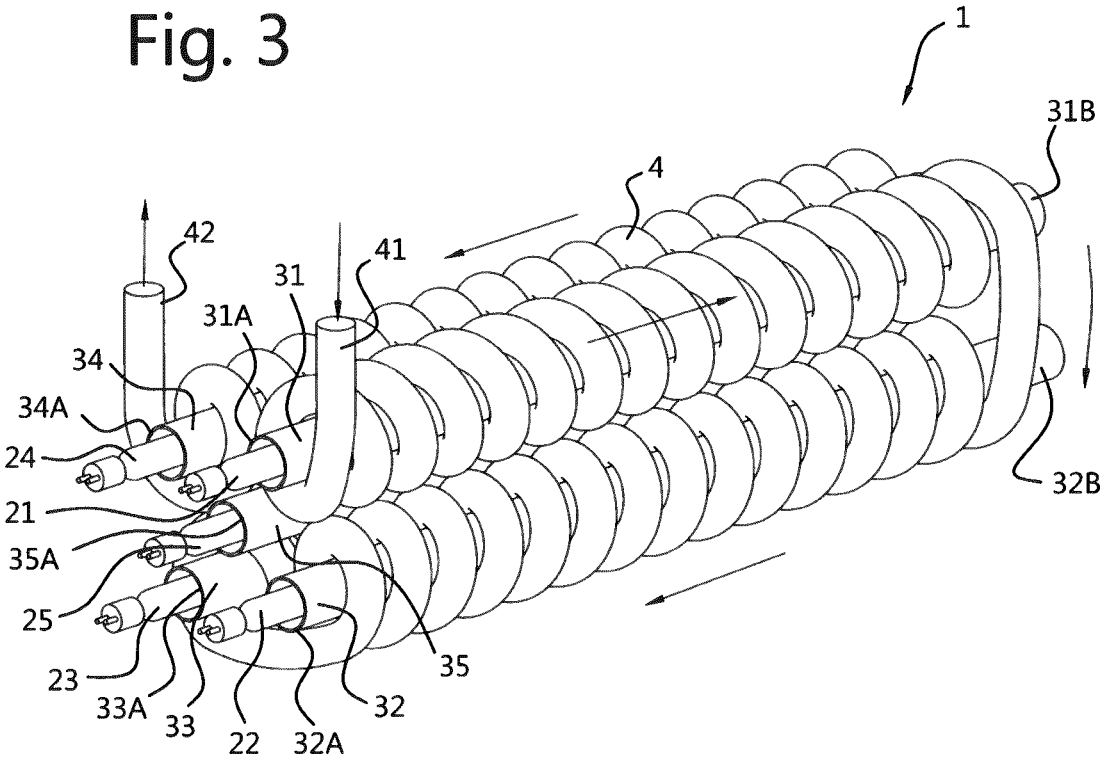
FIG. 3 shows in a view in perspective an embodiment of a heating device according to the invention, with five heat sources and five respective casings.
Figure 4:
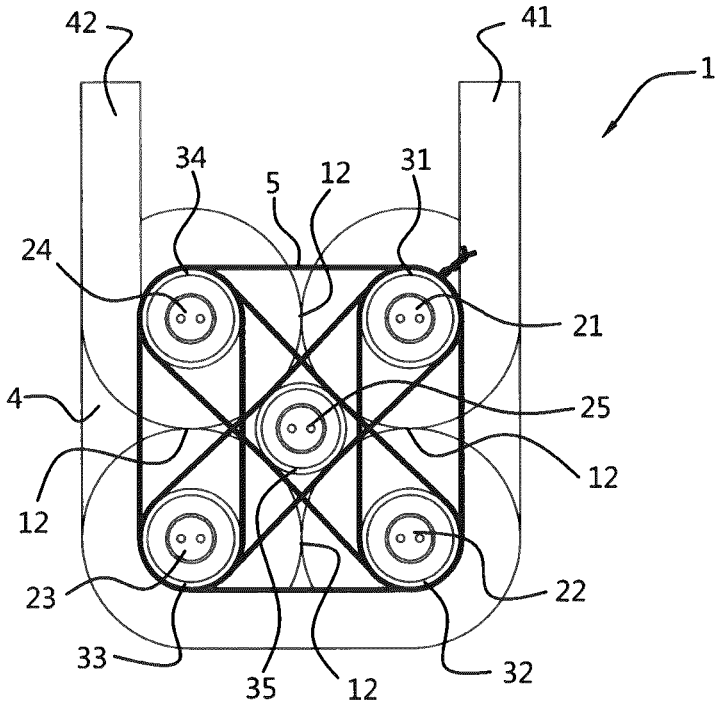
FIG. 4 shows a front elevational view of the heating device of FIG. 3.

In FIGS. 3 and 4, a heating device 1 is shown which comprises five infrared heat sources 21, 22, 23, 24, 25 with five respective casings 31, 32, 33, 34, 35. The casings have a proximal end 31A, 32A, 33A, 34A, 35A wherefrom the heat source is inserted and a distal end 31B, 32B, 33B, 34B, 35B. The infrared heat sources 21, 22, 23, 24, 25 each comprise an infrared quartz lamp.

A single conduit 4, through which in use a liquid to be heated flows, is wound as a spiral successively around each of the first four casings 31, 32, 33, 34 and the respective heat sources 21, 22, 23, 24 therein. The flow is illustrated by arrows at the inlet 41 and the outlet 42, and along the spiral shaped portions of the conduit. The first four casings 31, 32, 33 and 34 are placed in a square, and the fifth casing 35 is placed in the middle. The conduit 4 spirals around the first casing 31 and the third casing 33 in one longitudinal direction, from the proximal end to the distal end and around the second casing 32 and the fourth casing 34 in the opposite longitudinal direction. The casings 31, 32, 33, 34, 35 are spaced apart such that the conduit 4 spiralling around the casings 31, 32, 33, 34 is also is contact with the central casing 35.

FIG. 4 shows how this alignment can be fixed in place using, for example, a metal wire 5. By winding the wire around the casings 31, 32, 33, 34, 35, the entire heating device 1 is fixed. This is especially useful if the conduit 4 is a flexible conduit, and thus does not fix the casings 31, 32, 33, 34, 35 in place. In this figure is also best visible that sections of the conduit belonging to different spiral shaped portions touch each other and form an interface 12 where heat can be transferred from one section to another section.

Figure 5:
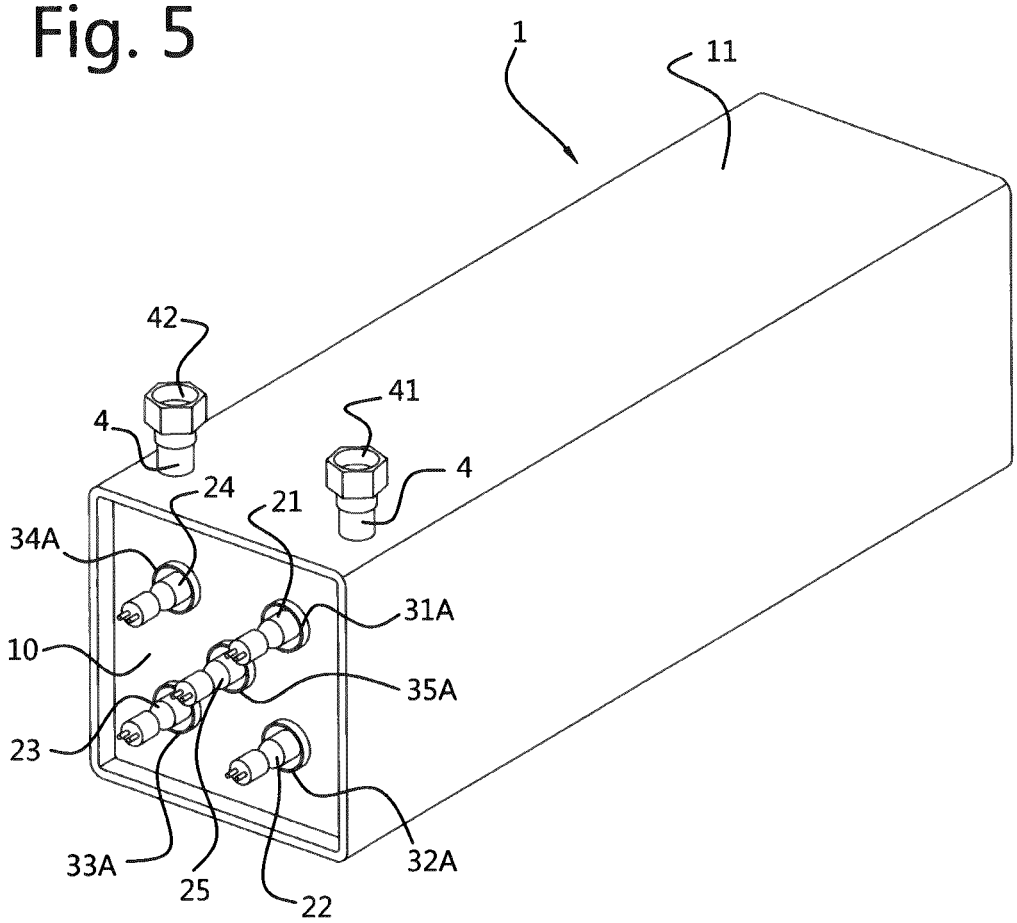
FIG. 5 shows in a view in perspective the heating device of FIG. 3 including a housing.

In FIG. 5, the configuration of FIGS. 3 and 4 is shown, encased in a housing 11 containing an insulating block 10. The housing 11 can be used to attach the heating device 1 to other devices or surfaces. The inlet 41 and outlet 42 of conduit 4 extend from the housing 11. At least the proximal ends 31A, 32A, 33A, 34A, 35A of each of the casings 31, 32, 33, 34, 35 also extends from one end of the insulating block 10, so the infrared heat sources 21, 22, 23, 24, 25 can be reached, for example for replacement. The housing 11 is preferably made of stainless steel, but it is also possible to omit the steel housing 11 and arrange another protective layer around the insulating block 10, which protective layer may also have insulating properties.

The insulating block 10 in this embodiment is preferably produced using a process of pouring and hardening an initially fluid heat insulating material. This ensures that the insulating material fills up all the voids and gaps around and between the loops of the conduit 4. The result is a cast block of heat insulating material in which the assembly of the conduit 4 and the casings 3 are embedded. In a practical embodiment of the device according to the invention the insulating material is a mix of glass granulate and an alumina cement.

It should be noted that it is possible to produce multiple layers of insulating material. For example, a mix of glass granulate and alumina cement may be used, around which one or more layers of aerogel are placed. Other combinations are also envisaged.

Also an insulating layer entirely made of glass is conceivable.

The liquid heating devices shown in the FIGS. 1-5 can be used in different installations for heating different liquids. As an example a central heating installation will be described in which the heating device 1 heats the heating water that circulates through the CV system including radiators. Another example is a frying installation for frying food, for example French fries.

Figure 6:
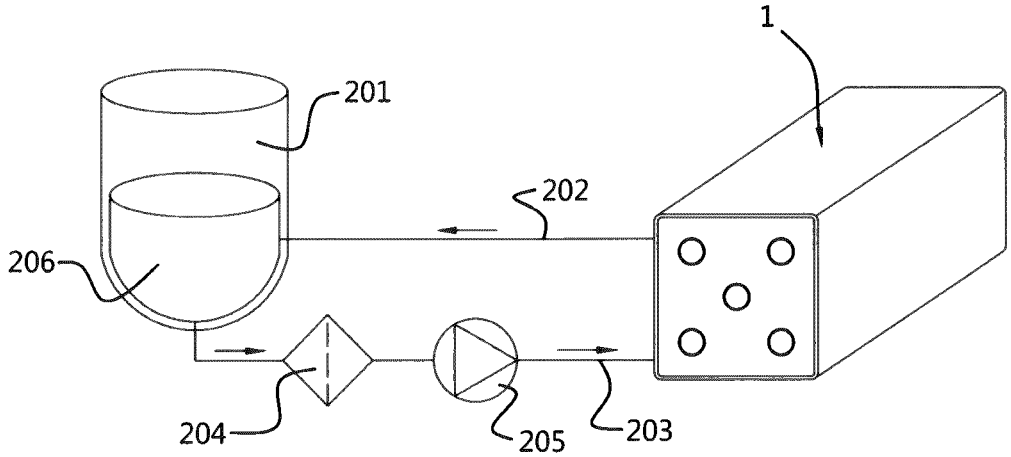
FIG. 6 shows schematically a deep frying system including a heating device as is shown in FIG. 5.

In FIG. 6 is shown a deep frying system comprising a deep frying pan 201 and a heater 1 as is shown separately in FIG. 5. The heater 1 and the deep frying pan 201 are connected by a supply line 202 and a return line 203 such that a circulating circuit for frying medium 206, e.g. frying oil, is formed. An oil filter 204 and an oil pump 205 are arranged in the return line 203. The deep frying pan 201 can be used to fry for example French fries. The oil filter is arranged upstream of the pump 205 such that the oil, which may contain particles as a result of the deep frying process, is filtered before it enters the pump 205.

The deep frying system in which the oil is circulated between the frying pan 201 and the heater 1 has a better performance with respect to more conventional frying systems, intended for, for example, professional kitchens. It is for example possible to heat 30 litres of frying oil to 175° C. with 9000 Watt minutes faster than the conventional deep frying systems which generally use 22000 Watt. Also the initial temperature drop in the frying pan when for example 5 kilograms of frozen fries are submerged in the oil is only 9° C., while in a more conventional frying system this temperature drop is about 15° C. In general the frying system performs better using less power.

Figure 7:
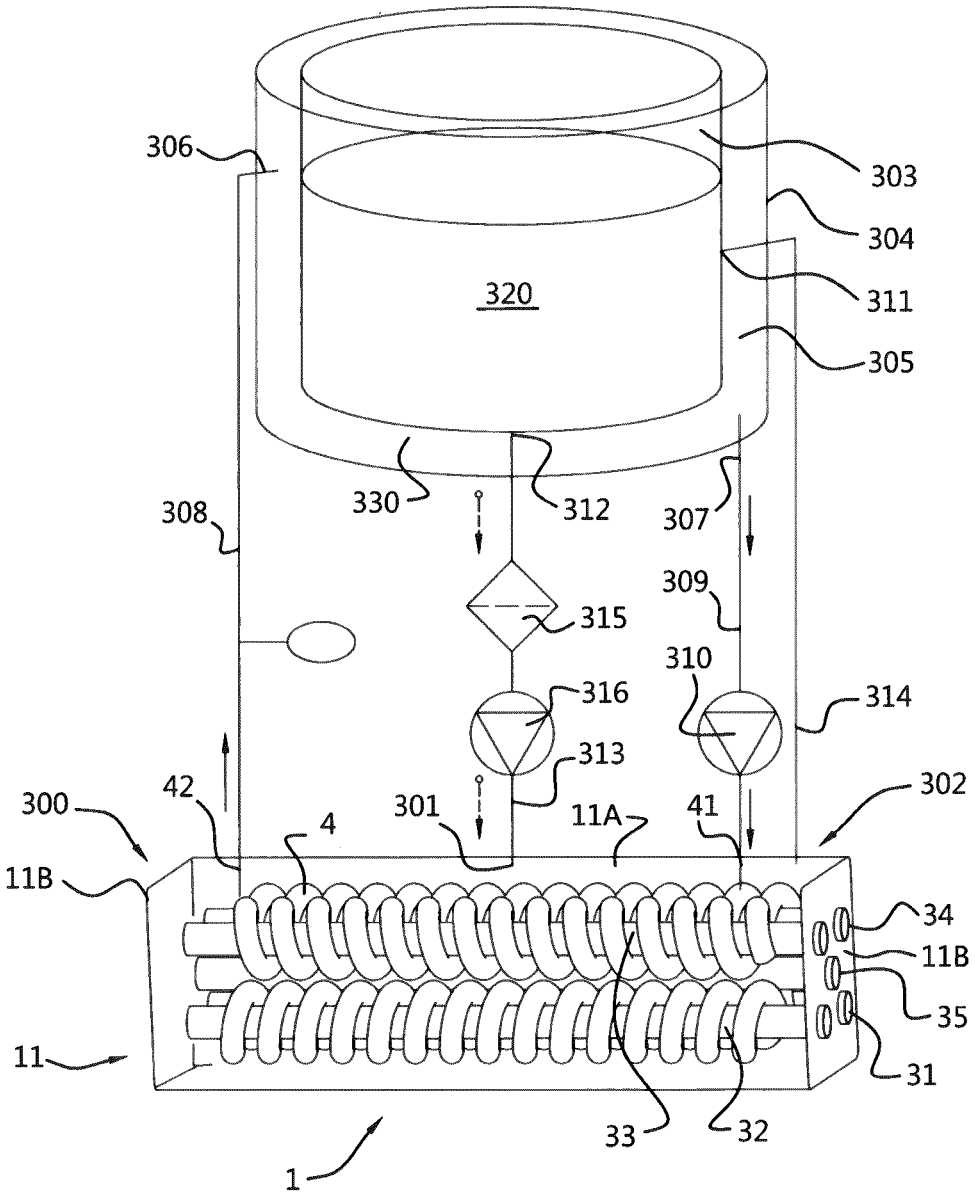
FIG. 7 shows schematically another deep frying system.

In FIG. 7 another deep frying system is shown. In this deep frying system an embodiment of the heating device is used which is different from the one shown in FIG. 5. In this embodiment the configuration of the casings 31-35 and the conduit 4 may be the same as is shown in FIG. 4. In the figure the conduit 4 is indicated very schematically with a fluid in it, but it may have the same configuration as in FIG. 3 and has an inlet 41 and an outlet 42.

The housing 11 is different and defines a closed chamber 300 which may be filled with a fluid. In the particular rectangular block shape, as is shown by way of example in FIG. 7, the housing 11 has a circumferential wall 11A and two head walls 11B. The conduit 4 and each of the casings 31-35 of the infrared heat sources, around which the conduit 4 is spirally wound, are arranged in the housing 11 and thus in the chamber. The chamber 300 has a chamber inlet 301 and a chamber outlet 302 for the fluid, wherein, in use, the fluid flows through the chamber 300 from the chamber inlet 301 to the chamber outlet 302.

The deep frying system comprises a deep frying pan 303. An outer wall 304 defines a buffer chamber 305 surrounding the deep frying pan 303, except for the top side thereof. The buffer chamber 305 has an inlet 306 and an outlet 307. The inlet 306 of the buffer chamber 305 is connected to the outlet 42 of the conduit 4 of the heating device 1 by a supply line 308. The outlet 307 of the buffer chamber 305 is connected to the inlet 41 of the conduit 4 of the heating device 1 by a return line 309. In the return line 309 a circulation pump 310 is arranged for circulating buffer medium between the buffer chamber 305 of the frying pan 303 and the conduit 4 of the heating device 1.

The frying pan 303 has an inlet 311 and an outlet 312. In a practical embodiment the outlet 312 is near the bottom of the frying pan 303 such that the frying pan can be emptied easily. The inlet 311 of the frying pan 303 is connected to the outlet 302 of the chamber 300 of the heating device 1 by a supply line 314. The outlet 312 of the frying pan 303 is connected to the inlet 301 of the chamber 300 of the heating device 1 by a return line 313. In the return line a filter 315 for the frying medium and a circulation pump 316 for the frying medium is arranged.

The frying medium is a frying oil 320. The buffer medium is a liquid and may in a practical embodiment be a thermal oil 330. The thermal oil 330 is circulated in a closed circuit between the buffer chamber 305 of the frying pan 303. The frying oil 320 is circulated between the interior of the frying pan 303 and the heating device 1, in particular the chamber of the heating device. It should be noted that in this example the frying pan 303 is connected to the chamber 300, and the buffer chamber 305 is connected to the conduit 4 of the heating device 1, but that it is also possible, in another embodiment to connect the frying pan to the conduit 4 of the heating device 1 and the buffer chamber 305 to the chamber 300 of the heating device 1.

Heat exchange between the frying oil and thermal oil circulating circuits takes place in the heating device 1 between the chamber 300 of the heating device 1 and the conduit 4 running through said chamber 300, and between the frying pan 303 and the surrounding buffer chamber 305. This particular embodiment of a deep frying system has proven to be surprisingly effective, wherein only a short initial heating time to operation temperature is necessary and wherein a temperature drop, when for example frozen good is submerged in the frying oil, is minimized, and may be only about 2° C. This is very good for the quality of the fried goods. Moreover it may lead to an energy use which is about half of the energy use of a conventional energy use of conventional deep frying systems of a similar size using induction to heat the frying pan.

The use of this deep frying system, which is able to maintain the temperature better than existing systems opens up the possibility to operate the deep frying system at a frying oil temperature which is lower than the temperature at which conventional deep frying systems have to be operated. Lower frying oil temperature may in general be desired to prevent quick degradation of the frying oil and to prevent the forming of agents in the frying oil which may be harmful for the human health. However, in conventional deep frying systems the temperature drop may be considerable (e.g. 15° C.), whereby the frying temperature would become too low, which may compromise the quality of the deep fried product, for example because the product can absorb too much of the frying oil. To overcome this the frying oil temperature is set on a higher temperature in conventional systems, such that the oil temperature does not drop under a certain value when for example frozen product is put in the oil. However, as said, the higher temperature may promote the quicker degradation of the frying oil and forming of harmful agents in the frying oil. With the frying system of FIG. 7 incorporating the present invention, the temperature drop can be kept within smaller bounds and consequently the frying system may for example operate on a temperature of 165° C. instead of 175° C.

It is to be noted that the deep frying systems shown in FIGS. 6 and 7 use a heating device 1 wherein the conduit is wound spirally around the casing(s) of the infrared heat source(s) as is for example illustrated in FIGS. 1-4. Although this particular arrangement of the conduit facilitates the heating of the frying medium, it is not essential for such a deep frying system that the conduit is wound spirally around the casing(s). Other configurations of the conduit are also possible, and even other heat exchanging structures in the heating device are conceivable.

An important feature of the embodiments of the deep frying system of the invention is that, contrary to known deep frying systems, the frying medium is not heated in the frying pan itself, but is heated remote therefrom in a heating device, and circulated between the frying pan and the heating device. The embodiment shown in FIG. 7 even has the additional feature that it is adapted to heat two media, which are circulated each through their own circuit and wherein heat exchange is provided between the two circuits. Hence one of the media is used as a buffer medium, e.g. thermal oil, and the other one is used as a frying medium, e.g. frying oil.

Figure 8:
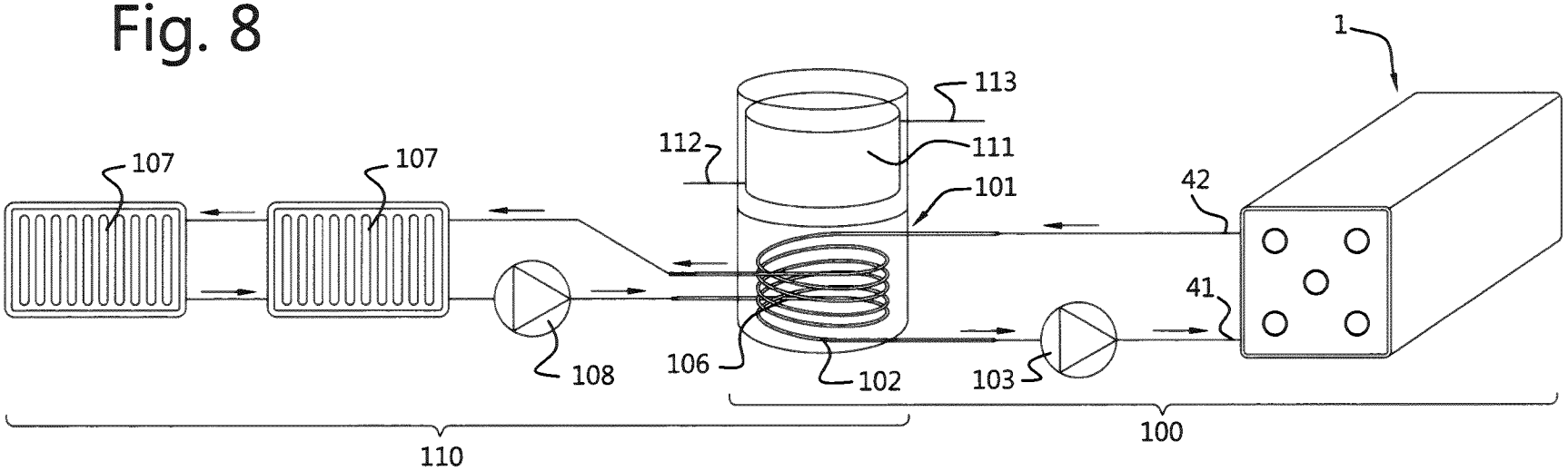
FIG. 8 shows schematically a central heating system including a heating device as is shown in FIG. 5.

In FIG. 8 is shown a central heating system including a heating device 1 which is shown in FIG. 5. The heating device 1 is comprised in a first closed liquid circuit 100 in which furthermore a heat exchanging coil 102 of a boiler 101 is arranged. The liquid is circulated through the closed circuit 100 by means of a pump 103. In a particular embodiment the liquid is a thermal oil, and the pump 103 is an oil pump which circulates the oil through the closed oil circuit 100. The inlet 41 and outlet 42 of the heater 1 are connected to the return line 105 and the supply line 104, respectively, of the boiler 101.

The central heating system comprises a closed radiator circuit 110. This second closed radiator circuit 110 comprises a coil 106 incorporated in the boiler 101 which exchanges heat with the coil 102 of the first closed liquid circuit 100. The coil 106 is connected through heating pipes with radiators 107. In the return pipe a pump 108 is arranged which pumps around the heating liquid, which in a practical embodiment of the heating system may be water or glycol.

In the shown embodiment the boiler 101 also comprises a water reservoir 111, which is connected by an inlet pipe 112 to the water main in order to fill the reservoir 111, and which is connected to an outlet pipe 113 to transport heated water to a warm water tap, for example. The heat provided by the coil 102 of the closed oil circuit 100 is conveniently used to heat the water in the boiler reservoir 111.

Figure 9:
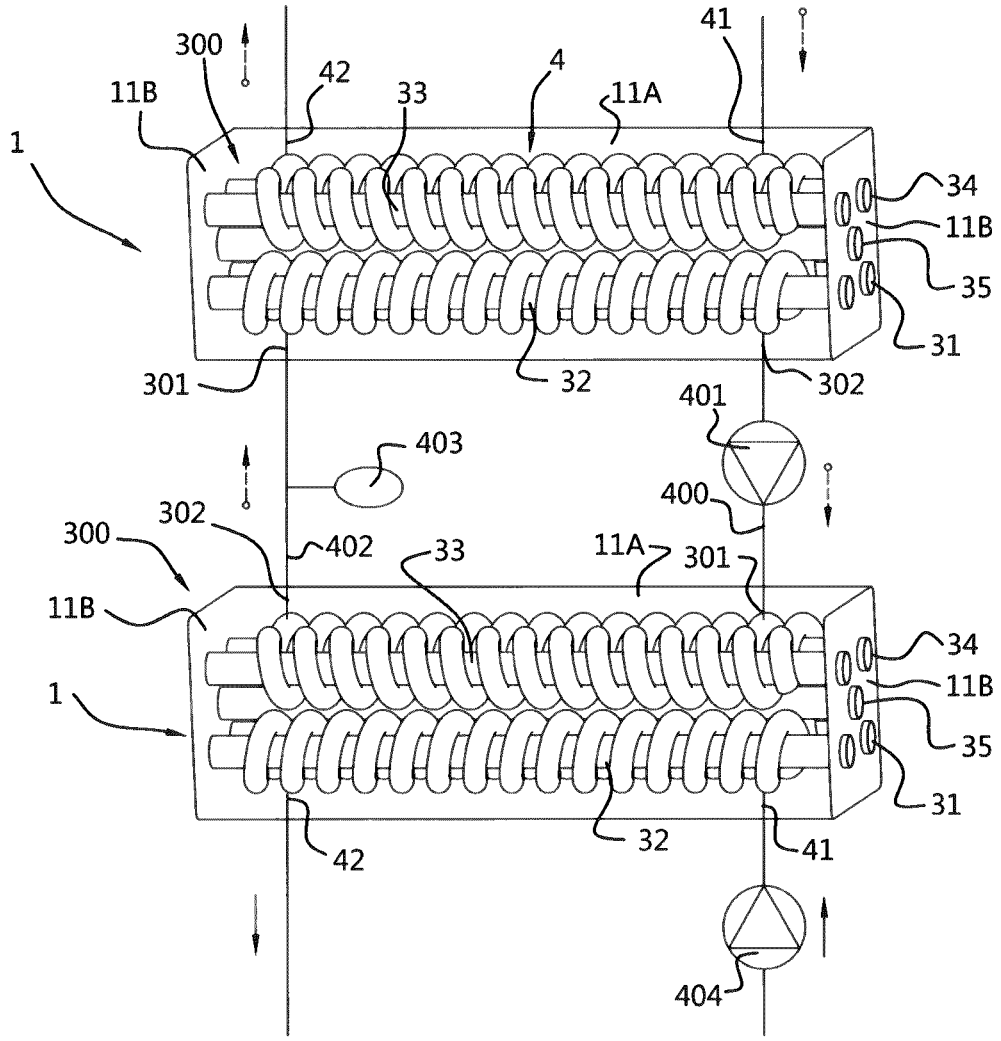
FIG. 9 shows schematically two heating devices according to the invention in series for a central heating system.

In FIG. 9 is shown a configuration of two heating devices in series, which can be used for a central heating system.

The heating devices are similar to the one described with reference to FIG. 7. We will therefore refer to the description above referring to FIG. 7 for a description of the different parts of the heating devices in FIG. 9. The same reference numerals will be used for the same parts.

The conduit 4 and each of the casings 31-35 of the infrared heat sources, around which the conduit 4 is spirally wound, are arranged in the housing 11 and thus in the chamber 300. The chamber 300 has a chamber inlet 301 and a chamber outlet 302 for the fluid, wherein, in use, the fluid flows through the chamber 300 from the chamber inlet 301 to the chamber outlet 302.

The chambers 300 of the two connected heating devices 1 are connected by connecting the outlet 302 of a first chambers 300 to the inlet 301 of the second chamber 300 by a connection line 400 in which a circulation pump 401 is arranged. Furthermore the inlet 301 of the first chamber 300 is connected to the outlet 302 of the second chamber 300 by a connection line 402 in which an accumulator 403 is arranged. The medium that is contained in the housings 300 may be thermal oil.

The inlet 41 of the lowest heating device 1 in the figure is connected to a return line of a central heating system. In said return line a circulation pump 404 is arranged to pump heating medium to radiators 107 (cf. FIG. 8). The outlet of the lowest heating device 1 in the figure is connected to the feed line of the central heating system.

The inlet 41 and outlet 42 of the upper heating device 1 in FIG. 9 can be connected to a warm water boiler including a warm water reservoir.

The two heating devices 1 in FIG. 9 can be operated separately and in combination by means of a control system. When the pump 401 is operated the thermal oil is circulated from one device 1 to the other and back. The infrared sources of one or both devices 1 can be operated. In such a way the most energy efficient option can be selected by the control system to heat the central heating medium (e.g. water or glycol) and/or to heat tap water, depending on the instant demand of both.

It is to be noted that the heating systems shown in FIGS. 8 and 9 use one or more heating devices 1 wherein the conduit is wound spirally around the casing(s) of the infrared heat source(s) as is for example illustrated in FIGS. 1-4. Although this arrangement of the conduit facilitates the heating of the media flowing through the heating devices, it is not essential for such a heating system that the conduit is wound spirally around the casing(s). Other configurations of the conduit are also possible, and even other heat exchanging structures in the heating device are conceivable.

Figure 10B:
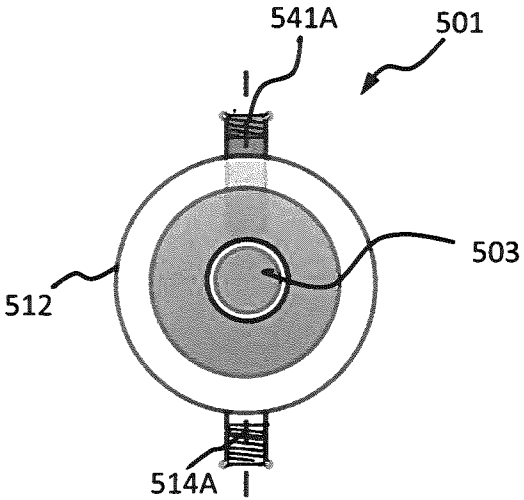
FIGS. 10A and 10B show schematically in two views an embodiment of a heating device made for laboratory use.
Figure 10A:
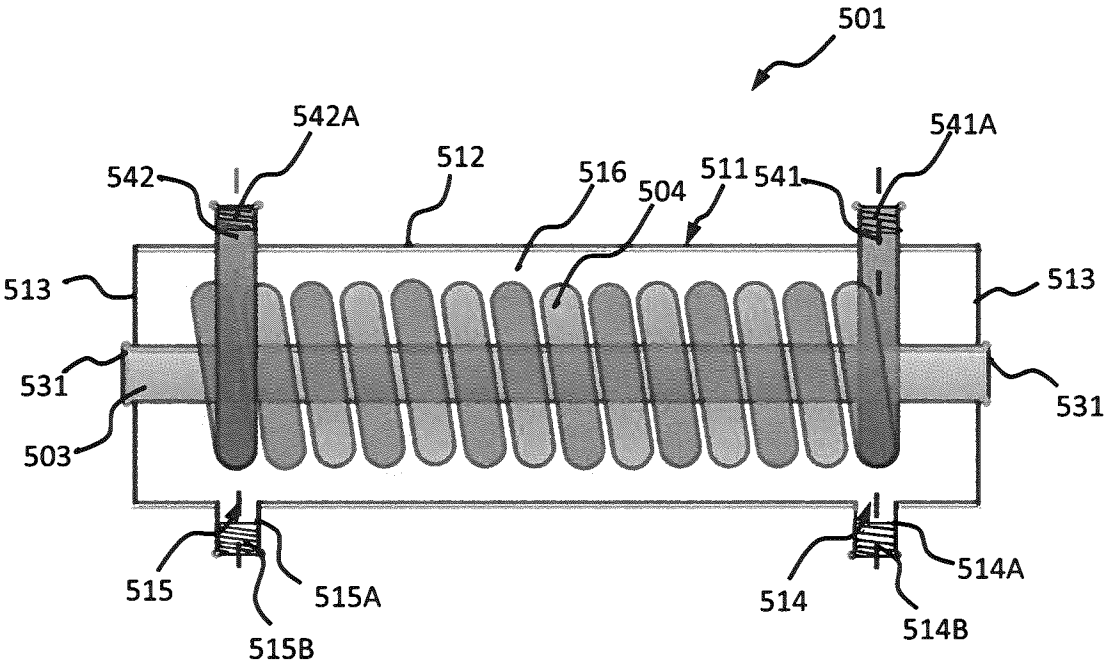

In FIGS. 10A and 10B is shown a heating device 501 according to the invention which is mainly made of glass. In this embodiment the casing 503 is formed by a straight glass tube. Around the glass tube 503 a spirally wound glass tube 504 is arranged which constitutes the conduit 504. The device 501 further includes a cylindrical housing 511 made of glass. The casing 503 and the conduit 504 are received in the housing 511.

The spirally wound glass conduit 504 has an inlet portion 541 and an outlet portion 542 which each extend through the cylindrical wall 512 of the housing 511, preferably in a radial direction. The inlet portion 541 and outlet portion 542 are fixed to said cylindrical wall 512 so as to fix the spiral conduit 504 in the housing 511. Preferably the end portions 541 and 542 of the spiral conduit 504 and the cylindrical wall 512 are attached by fusing both glass parts together. The inlet and outlet portion 541 and 542 may be coupled with external tubes, pipes or the like, and thereto it has a threaded portion, which may be male or female, such that a threaded connection can be established with the external tubes, pipes or the like.

The cylindrical housing 511 has two opposite end walls 513 closing the ends of the cylinder. The end walls 513 are preferably made of glass, preferably formed in one piece with the cylindrical wall 512. The casing 503 extends coaxially through the cylindrical housing 511 and has end portions 531 that extend through the end walls 513 of the housing 511. Preferably the respective end portions 531 of the casing 503 and the respective end walls 513 of the housing 511 are attached by fusing the glass end walls 513 and the glass end portions 531 of the casing 503 together.

The cylindrical wall 512 has an inlet 514 and an outlet 515 of the chamber 516 defined by the housing 511. The inlet 514 and outlet 515 are located at an axial distance from each other. The inlet 514 and outlet 515 of the chamber 516 comprise preferably tubular connection pieces 514A, 515A, preferably made of glass. These connection pieces 514A, 515A may be formed in one piece with the housing 511 or may be fused with the housing 511 to attach them. The tubular connection pieces 514A, 515A may be coupled with external tubes, pipes or the like, and thereto it has a threaded portion 514B, 515B, which may be male or female, such that a threaded connection can be established with the external tubes, pipes or the like.

In a possible embodiment the inlet and outlet 514, 515 of the chamber 516 are located radially opposite the inlet and outlet 541, 524 of the spiral conduit 504.

The glass casing 503 has open ends and an elongate infrared light is inserted therein. The device is as such usable in laboratory applications, such as in evaporator/condensor assemblies.

The invention claimed is:

1. A heating device for heating a liquid, comprising:

a plurality of infrared heat sources and a plurality of casings of heat conducting material, each one of the plurality of infrared heat sources being accommodated in a respective corresponding one of the plurality of casings, wherein the plurality of casings are placed parallel to each other and positioned in a round or polygonal configuration, a conduit of a heat conducting material, wherein the conduit has an inlet and an outlet and wherein the liquid to be heated in use flows through the conduit from the inlet towards the outlet, wherein the conduit is wound spirally around each one of the plurality of casings of the plurality of infrared heat sources in said round or polygonal configuration to facilitate, in use, emission of infrared radiation by the plurality of infrared heat sources through the plurality of casings and the conduit into the liquid flowing through the conduit so as to heat the liquid, and an additional casing with an additional infrared heat source which is placed at the centre of said round or polygonal configuration and in thermal contact with the conduit.

2. The heating device according to claim 1, furthermore comprising a housing, wherein the conduit and said each one of the plurality of casings of the plurality of infrared heat sources, around which the conduit is wound, are arranged in the housing.

3. The heating device according to claim 2, wherein the housing furthermore contains a thermal buffering material or medium which surrounds the conduit and the plurality of casings.

4. The heating device according to claim 3, wherein the thermal buffering material is a heat insulating material.

5. The heating device according to claim 3, wherein the thermal buffering material is formed by a layer of heat insulating material which is arranged around the assembly of the conduit and the plurality of casings of the plurality of infrared heat sources through a process of pouring and hardening.

6. The heating device according to claim 5, wherein the insulating material is a mix of glass granulate and an alumina cement.

7. The heating device according to claim 3, wherein the thermal buffering medium is a fluid.

8. The heating device according to claim 2, wherein the housing defines a chamber surrounding the conduit and the plurality of casings, said chamber being adapted to contain a circulating fluid, and said chamber having a chamber inlet and a chamber outlet for the circulating fluid, wherein, in use, the circulating fluid flows through the chamber from the chamber inlet to the chamber outlet.

9. The heating device according to claim 2, wherein the inlet and outlet of the conduit extend from the housing, so as to allow attachment thereof to a source of the liquid and a desired outflow for the liquid.

10. The heating device according to claim 2, wherein at least one end of one or more of the plurality of casings is open on one side of the housing, so as to allow insertion or removal of the infrared heat source(s) from the casing(s).

11. The heating device according to claim 1, wherein each of the plurality of casings has a proximal end and a distal end, wherein the proximal ends of the plurality of casings are all located at the same side, and in that the conduit extends around one of the plurality of casings from the proximal end to the distal end and extends around a next or a previous casing(s) from the distal end to the proximal end, whereby a back-and-forth flow path is created.

12. The heating device according to claim 1, wherein the conduit forms a spiral around each of the plurality of casings wherein the spiral around one of the plurality of casings is in thermal contact with the spiral around at least one other of the plurality of casings.

13. The heating device according to claim 1, wherein each one of the plurality of infrared heat sources is separately operable.

14. The heating device according to claim 1, wherein each one of the plurality of infrared heat sources is adapted to be operated at variable wattages.

15. The heating device according to claim 1, wherein each one of the plurality of infrared heat sources is a quartz infrared lamp.

16. The heating device according to claim 1, wherein the plurality of casings is made of metal; or wherein the conduit is made of metal; or wherein the housing is made of metal.

17. The heating device according to claim 1, wherein the plurality of casings is made of glass; or wherein the conduit is made of glass; or wherein the housing is made of glass.

18. The heating device according to claim 1, wherein the plurality of casings is made of glass, the conduit is made of glass and the housing is made of glass.

19. A central heating system comprising a liquid heating system according to claim 1, wherein the central heating system comprises a closed radiator circuit in which at least one radiator is comprised, wherein the central heating system furthermore comprises a heat exchanging arrangement to exchange heat between the first closed circuit and the closed radiator circuit.

20. The central heating system according to claim 19, wherein the system furthermore comprises a warm water reservoir, wherein a further heat exchanging arrangement is present between the first closed circuit and the warm water reservoir, to heat the water in said reservoir.

21. The central heating system according to claim 19, wherein the first liquid in the first closed circuit is a thermal oil.

22. The central heating system according to claim 19, wherein the liquid in the closed radiator circuit is water or glycol.

* * * * *